United States Patent [19]

Wright et al.

[11] Patent Number: 4,614,398

[45] Date of Patent: Sep. 30, 1986

[54] SHIELDED CABLE TERMINAL CONNECTION

[75] Inventors: James R. Wright, Guilford; Ronald B. Huggins, Norwich, both of N.Y.

[73] Assignee: Simmonds Precision, Tarrytown, N.Y.

[21] Appl. No.: 684,693

[22] Filed: Dec. 21, 1984

[51] Int. Cl.[4] ..... H01R 13/46

[52] U.S. Cl. ..... 339/143 R; 339/177 R; 339/276 R

[58] Field of Search ..... 339/177, 143, 276 R, 339/103 R, 103 M, DIG. 3, 60, 94 R, 94 M

[56] References Cited

U.S. PATENT DOCUMENTS

| | | | |
|---|---|---|---|
| 2,636,072 | 3/1953 | Lamoureaux, Jr. | 339/143 R |
| 3,322,885 | 5/1967 | May et al. | 339/143 R |
| 3,448,430 | 6/1969 | Kelly | 339/143 R |
| 3,598,895 | 9/1971 | Garland | 339/143 R |
| 3,622,952 | 11/1971 | Hilbert | 339/177 R |
| 3,739,076 | 6/1973 | Schwartz | 339/DIG. 3 |
| 3,764,959 | 10/1973 | Toma et al. | 339/177 R |
| 3,990,765 | 11/1976 | Hill | 339/143 R |
| 3,992,773 | 11/1976 | Duffner et al. | 339/143 R |
| 4,025,145 | 5/1977 | Shaffer et al. | 339/143 R |
| 4,046,451 | 9/1977 | Juds et al. | 339/177 R |
| 4,090,768 | 2/1979 | Togoning | 339/143 R |
| 4,243,290 | 1/1981 | Williams | 339/143 R |
| 4,382,653 | 1/1983 | Blanchard | 339/143 R |
| 4,433,206 | 6/1984 | Lewis | 174/35 C |
| 4,441,780 | 4/1984 | Walters | 339/143 R |
| 4,447,100 | 5/1984 | Dyce et al. | 339/14 R |

*Primary Examiner*—Gil Weidenfeld
*Assistant Examiner*—David L. Pirlot
*Attorney, Agent, or Firm*—Harry Williams

[57] ABSTRACT

What is proposed is an apparatus for a shielded terminal connector that eliminates EMI leakage from coaxial cables in which a resilient bushing of a conductive material is inserted between exposed shield portions of the coaxial cable and the interior surface of a backshell housing, the latter being compressed onto a connector housing for the cable and the resilient bushing itself so that the bushing is gripped tightly by the backshell housing and thus completely fills the space between the exposed shield portions of the cable and the surrounding interior surface of the backshell housing.

7 Claims, 5 Drawing Figures

FIG 1
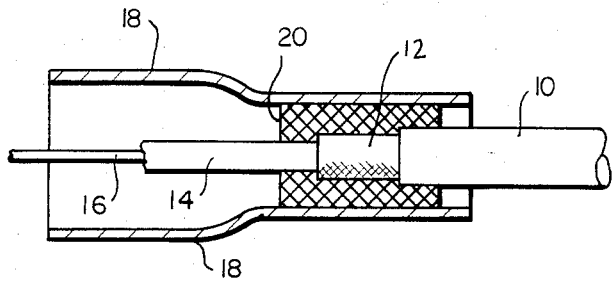
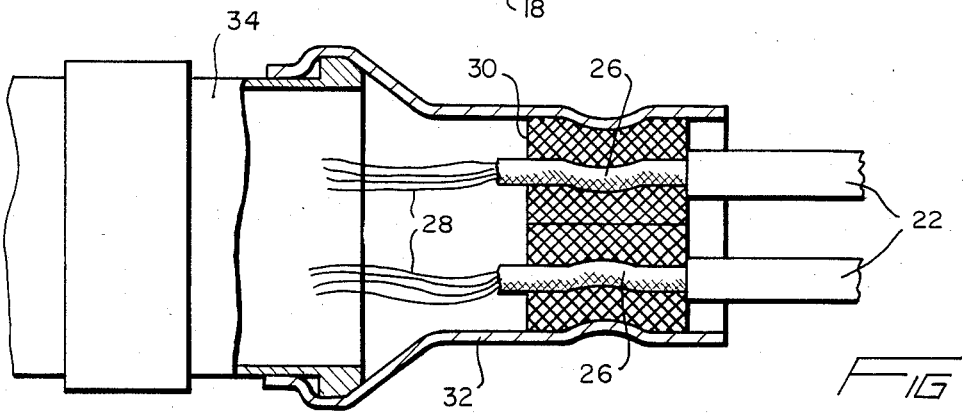
FIG 2
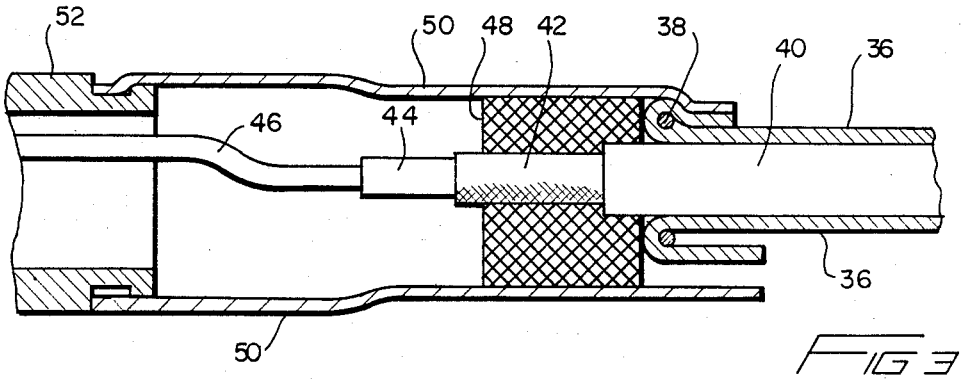
FIG 3
FIG 4
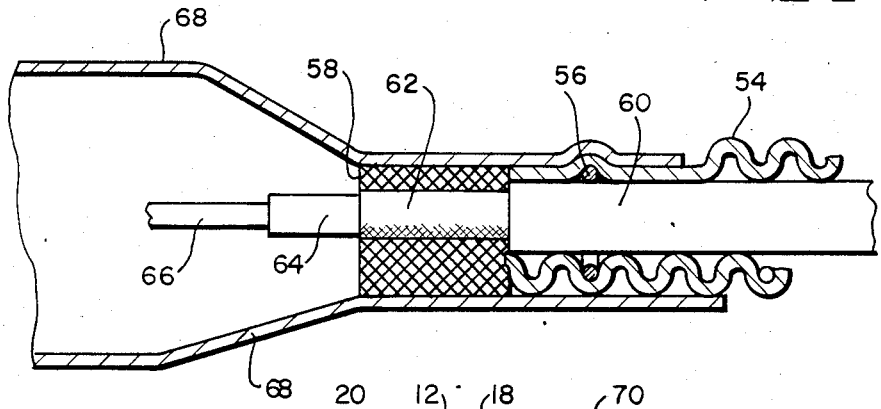
FIG 5
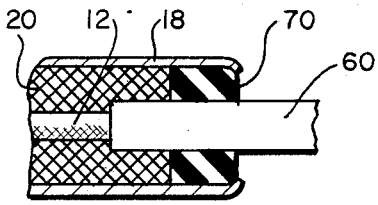

SHIELDED CABLE TERMINAL CONNECTION

BACKGROUND OF THE INVENTION

The present invention relates to shielded cable connections to prevent EMI and RFI leakage from the cable conductors, particularly at connection and terminal points within the cable system when such systems are not fully shielded externally but rather depend on internal shielding methods in which the shielded conductor is terminated to the shell or backshell of the cable system.

In the past termination of the shield on the cable has been done by connecting the shield to the backshell via a conductor segment, usually a pigtail type of conductor, a plate member, or a ring structure. In the case of the pigtail type of connection between cable shield and exterior shell of the cable system, multiple cables necessitate separate shield terminations, and typically there is always some EMI opening that is not shielded around the cable since this type of connection is not fully circumferential. The various conventional fillers and insulation used for strain relief clamping between the cables and the shell structure do not provide the necessary shielding. In those cases where a plate structure is used, such as shown in U.S. Pat. No. 4,447,100 and U.S. Pat. No. 4,382,653, there is usually a free space existing between the cable and the shell structure despite the presence of the connecting plates so that EMI leakage is possible via the spacing between the plate structures. Further, such rigid connecting structures are vulnerable to cracking and breaking over time, thus further contributing to EMI leakage. Finally, in those cases where a clamping ring structure is used, such as shown in U.S. Pat. No. 3,598,895, the same defects as described in the case of plate structures are present and indeed are even compounded by the absence of a reasonable intervening space between the cable and the exterior shell structure, so that shielding is inhibited by the close proximity of shell structure and cable. There is a need therefore to provide a shielded terminal connection for cables which allows for simple construction at a low cost and which virtually assures complete EMI shielding without leakage.

SUMMARY OF THE INVENTION

It is the general purpose and primary object of the invention to provide a low-cost shielded terminal connection for cables that will overcome the aforementioned defects and disadvantages. In particular, it is the purpose of the invention to provide a light weight shielded terminal connection which can be assembled quickly and simply with far less attention paid to critical tolerances than heretofore, and which presents a smooth streamlined appearance without the appearance of a solder and/or brazing material on the casing.

According to the principles of the invention there is provided an apparatus and a method for producing the apparatus in which the outer cable insulating jackets are removed to expose the shield for a prescribed length around its full circumference. Each cable is then fitted with a metal mesh bushing, according to the invention. The metal mesh bushings are resilient, allowing several to be nestled together to fill the available space where the cables enter the connector backshell. In so doing electrical contact is made around the O.D. of each cable shield and around the full I.D. of the backshell. The complete filling of the cable-to-backshell space effectively completes the shield and eliminates the EMI leakage problems inherent in conventional designs.

Suitable compression for deforming the metal bushings into the required shape to provide the fill may be accomplished by a variety of processes including die crimping and magnetic impulse forming. By means of such methods the cables are gripped with some degree of strain relief.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 shows a schematic illustration of a shielded terminal connection embodying the principles of the invention;

FIG. 2 is a schematic illustration of a shielded terminal connection using multiple shielded cables according to the invention;

FIG. 3 is a schematic illustration of a terminal connection according to the invention showing the method of forming the backshell structure;

FIG. 4 is a schematic illustration of a terminal connection according to the invention showing a different construction of the tubing used with backshell; and FIG. 5 is a schematic illustration of a terminal connection according to the invention employing a further embodiment.

DETAILED DESCRIPTION

Referring now to FIG. 1, there is shown a coaxial cable 10 having a portion thereof peeled back to expose a shield mesh 12. An inner sheath member 14 is shown extending from the shielded portion, and a cable conductor 16 is shown exposed for connection with a suitable connector at the terminal station, not shown. A metallic housing 18, however, is shown which forms part of the terminal connector station, and interposed between the metallic housing and the shielded coax cable is a monel, nickel or inconel mesh contained in a knitted sock. This mesh member 20 completely surrounds the cable 10 and its exposed shield 12 and provides both a shield ground and a mechanical grip on the coax cable 10. In accordance with the principles of the invention the metallic housing is collapsed onto the mesh 20 for compressing the same into a tight secure fit around the cable 10.

FIG. 2 shows a modification of the embodiment shown in FIG. 1, but without departing from the principles of the invention. In this particular arrangement according to the invention a dual line cable 22 is shown entering into the housing 32 in which the dual cables expose their respective shields 26 for the purpose of being gripped by the bushing member 30 comprising a monel mesh as previously described. Conductors 28 extend through the interior space of the connnector 34, as shown, for the purpose of making suitable terminal connections. The backshell member 32 can be a magnaform member of nickel plated aluminum which is compressed around the mouth of the housing 34, as shown, and deformed as well into the monel mesh housing member 30 to thereby exert a tight mechanical grip on the cables.

In FIG. 3 a further modification of the invention is shown in which the outer sheath 36 is turned back on itself around a supporting ring member 38 at the mouth of the backshell casing member 50. This outer sheath member 36 may be a colored teflon tubing which surrounds coaxially a cable casing 40 which in turn is stripped for the purpose of exposing the shield 42, as previously described. A further extension 44 comprises stranded cable conductors 46 which are shown connected to suitable terminals within the terminal housing 52. The tubular backshell, comprising electrodes nickel plated aluminium, as previously described, is shown in the unformed or uncompressed state below the centerline of the Figure and in a formed or compressed state above the centerline of the Figure. The mesh bushing member 48 is shown, as previously, filling the space between the shield 42 and the backshell 50.

In the embodiment of FIG. 4 a cable 60 is shown having a convoluted outer tubing 54. In the bottom half of the Figure the convoluted tubing is shown in the unformed state entering the backshell member 68 along with the cable 60. As in the previous embodiments described, a bushing member 58 is shown filling the circumferential space between the shielded portion 62 of the cable 60 and the backshell 68. the cable 60 is seen to extend via the coaxial extensions 64,66 into the interior space of the backshell to make a suitable connection with a connector, not shown. In the formed condition the terminal connection according to the invention is seen to have the backshell compressed on the mesh busing 58 and the convoluted outer sheath 54 which is seen to have a support ring 56 surrounding the cable 60 in order to provide a gripping ridged portion.

FIG. 5 shows the addition of a grommet seal member 70 for the arrangement shown in FIG. 1. The seal member 70 may be composed of a silicone having fuel resistant applications, and the backshell 18 is magnetic impulse formed so as to be chamfered over the edge of seal member. If multiple cables are used in the terminal connector, then of course each cable is made to pass through a suitable hole in the grommet sealing member 70. It should also be understood that the backshell 18 can be impulse formed against the vertical dimension of the mesh member 20, thus dispensing with the grommet member; or as shown in FIG. 1, the backshell 18 can extend beyond the member 20 to form a flange or rim portion. In such cases where there is no need for a seal, such as the grommet 70, the terminal connector according to FIGS. 1 and 2 can be used. On the other hand, where a seal is required, the emodiments shown in FIGS. 3, 4 and 5 can be used.

The method of compressing the backshell onto the connector housing and the mesh bushing, as above mentioned, may be accomplished by crimping or by magnetic impulse forming. The steps employed by such methods include the following sequence, (1) eliminate an outer portion of the cable to be shielded so as to expose the shielded portion, (2) insert the knitted mesh sock bushing according to the invention to surround the shielded portions of the exposed cable or cables, (3) use an electroless nickel plating over aluminum for the backshell material, (4) anchor backshell to the connector, (5) compress backshell onto the mesh bushing, and (6) (if a seal is required), lock the outer tube of the coaxial cable over a support ring, or provide a grommet seal at the outer end face of the mesh bushing.

The foregoing refers to preferred exemplary embodiments of the invention, it being understood that other embodiments and variants thereof are possible within the scope of the invention, the latter being defined by the appended claims.

What is claimed and desired to be secured by Letters Patent of the United states is:

1. A non-threadable shield terminal connector apparatus for eliminating EMI leakage comprising, at least one coaxial cable having an exposed shield portion, a generally tubular backshell housing having generally smooth exterior and interior surfaces for containing said shield portion, a resilient bushing of conductive material contiguously surrounding said shield portion and radially extending to the interior surface of said backshell housing, whereby the space between the shield portion of said cable and the adjacent interior surface of said backshell housing is completely filled by said resilient bushing, and said backshell housing having a rim surrounding said resilient bushing and said coaxial cable, at least a portion of said rim being plastically deformed toward said coaxial cable for retention of said resilient bushing.

2. An apparatus according to claim 1, wherein said resilient bushing comprises one of a monel, nickel and inconel mesh contained in a knitted sock means.

3. An apparatus according to claim 1, wherein said backshell housing comprises a nickel plated aluminium, stainless steel or other conductive shielding.

4. An apparatus according to claim 1, wherein said coaxial cable comprises conductor strands extending into the interior of said backshell housing to a connector housing.

5. An apparatus according to claim 1, wherein a sealing member is provided adjacent said resilient bushing for surrounding said coaxial cable within the said rim of said backshell housing.

6. A shield terminal connector apparatus for eliminating EMI leakage comprising, at least one coaxial cable having an exposed shield portion, a generally tubular backshell housing for containing said shield portion, a resilient bushing of conductive material contiguously surrounding said shield portion and radially extending to the interior surface of said backshell housing, whereby the space between the shield portion of said cable and the adjacent interior surface of said backshell housing is completely filled by said resilient bushing, wherein said backshell housing terminates onto a connector housing on one side of said resilient bushing and as a rim portion surrounding said coaxial cable on the other side of said resilient bushing, and wherein said coaxial cable comprises an outer sheath convering turned back on itself within said rim portion of said backshell housing, and a support ring member contained by said back-turned portion of said cable.

7. A shield terminal connector apparatus for eliminating EMI leakage comprising, at least one coaxial cable having an exposed shield portion, a generally tubular backshell housing for containing said shield portion, a resilient bushing of conductive material contiguously surrounding said shield portion and radially extending to the interior surface of said backshell housing, whereby the space between the shield portion of said cable and the adjacent interior surface of said backshell housing is completely filled by said resilient bushing, wherein said backshell housing terminates onto a connector housing on one side of said resilient bushing and as a rim portion surrounding said coaxial cable on the other side of said resilient bushing, and wherein said coaxial cable comprises an outer sheath covering having a convoluted surface, and one of the convolutions of said convoluted surface containing a support ring member within said rim portion of said backshell housing.

* * * * *